United States Patent [19]

Ogita et al.

[11] Patent Number: 4,769,737

[45] Date of Patent: Sep. 6, 1988

[54] CIRCUIT FOR DRIVING A RELAY USED IN AN AC CIRCUIT, WITH A PROTECTION AGAINST CONTACT WELDING

[75] Inventors: Yasuhiro Ogita, Tsuzuki; Tamotu Maegawa, Oosaka, both of Japan

[73] Assignee: Kabushiki Kaisha Toshiba, Kawasaki, Japan

[21] Appl. No.: 62,603

[22] Filed: Jun. 16, 1987

[30] Foreign Application Priority Data

Jun. 20, 1986 [JP] Japan ..... 61-142700

[51] Int. Cl.[4] ..... H01H 47/12

[52] U.S. Cl. ..... 361/203; 307/137

[58] Field of Search ..... 307/137, 116, 117; 361/3, 2, 22, 160, 161, 165, 203

[56] References Cited

U.S. PATENT DOCUMENTS 4,153,922 5/1979 Azuma et al. ..... 361/3

FOREIGN PATENT DOCUMENTS 55-6973 2/1980 Japan .

60-55937 12/1985 Japan .

*Primary Examiner*—L. T. Hix

*Assistant Examiner*—David M. Gray

*Attorney, Agent, or Firm*—Cushman, Darby & Cushman

[57] ABSTRACT

A circuit for driving a relay having at least two contacts and an excitation coil. An AC power source is connected to the contacts of the relay for applying a voltage of a prescribed frequency to these contacts. A detector section compares a pulse current, induced in phase with the AC current supplied from the AC power source, with a reference value, thereby producing a detection signal. In accordance with this detection signal, the positive and negative phases of a signal having a cycle longer than, and being asychronous with, said AC current, are delayed alternately or at random, thereby generating a timing control signal. This timing control signal closes and opens said relay at random timings, thereby protecting the relay from contact welding.

13 Claims, 4 Drawing Sheets

CIRCUIT FOR DRIVING A RELAY USED IN AN AC CIRCUIT, WITH A PROTECTION AGAINST CONTACT WELDING

BACKGROUND OF THE INVENTION

This invention relates to a relay drive circuit, and more particularly, to a circuit for driving a relay used in an AC circuit, that includes protection against contact welding of the relay.

It is known in the art that a phenomenon called "contact welding" occurs in a relay when the relay is closed and opened many times, thereby repeatedly turning a DC circuit on and off. This contact welding phenomena is believed to develop in the following process.

A DC circuit is known which comprises a power source, and a relay connected in series to the power source. The relay has fixed and movable contacts, both made of copper. The movable contact comes into or out of contact with the fixed contact, in accordance with whether or not a voltage is applied from the power source to the relay. An overcurrent momentarily flows through the relay as the movable contact touches the fixed contact, or moves away therefrom. This overcurrent is dissipated as heat, which melts a portion of the movable contact made of copper. Part of the molten copper changes into positively charged copper ions. These ions move to the fixed contact, which is negatively charged. As the relay is closed and opened repeatedly, more and more copper ions move from the movable contact to the fixed contact. Finally, copper is deposited on the fixed contact, and the movable contact becomes welded to the fixed one. This undesirable welding is known as "contact welding".

Contact welding has been thought to take place only in a relay used in a DC circuit wherein copper ions move in one direction. It has not been considered a problem with a relay used in an AC circuit, wherein copper ions move back and forth between the fixed and movable contacts. Nonetheless, in the case of an AC circuit with a capacitive load, an overcurrent is generated when the relay closes, and the contacts of the relay are partly melted by the heat resulting from this overcurrent. In the case of an AC circuit with an inductive load, an arc is generated when the relay opens, and the contacts of the relay are partly melted by this arc. Namely, in both types of AC circuits, copper ions move in one direction every time a pulse current flows through the relay in synchronism with the power source frequency. Hence, contact welding is also a problem with AC circuits.

The contact welding causes a short-circuiting of the relay contacts. In some cases, this short-circuiting results in significant damage, such as the disconnection of the AC circuit from the power source and the burning of the load of the AC circuit. Therefore, there has been much demand for a relay used in an AC circuit, as well a DC circuit, which is protected from contact welding.

SUMMARY OF THE INVENTION

Accordingly, it is an object of the present invention to provide a circuit for driving a relay used in an AC circuit, with a protection against contact welding.

The relay-driving circuit of this invention has a timing control circuit for randomly controlling the timing of driving a relay. The relay drive circuit comprises a relay having at least two contacts and an excitation coil for connecting and disconnecting these contacts, and an AC circuit means having AC power lines connected to the contacts of the relay for applying an AC voltage of a predetermined frequency to a load. The relay drive circuit further comprises detector means, timing control means, and relay-driving means. The detector means compares a pulse current with a prescribed reference value, said pulse current having been included in the element driven by the load of the AC circuit means, in phase with the AC current flowing through the AC power lines. The detector means outputs a signal when the positive half-wave of the pulse current becomes greater than the reference value, or when the negative half-wave of the pulse current becomes less than the reference value. The timing control means generates a random-timing control signal in response to the signal output by the detector means, said control signal corresponding to the positive or negative half-wave of the pulse current. The relay-driving means randomly closes and opens the relay in response to the random-timing control signal output by the timing control means.

DETAILED DESCRIPTION OF THE PREFERRED EMBODIMENTS

Figure 1:
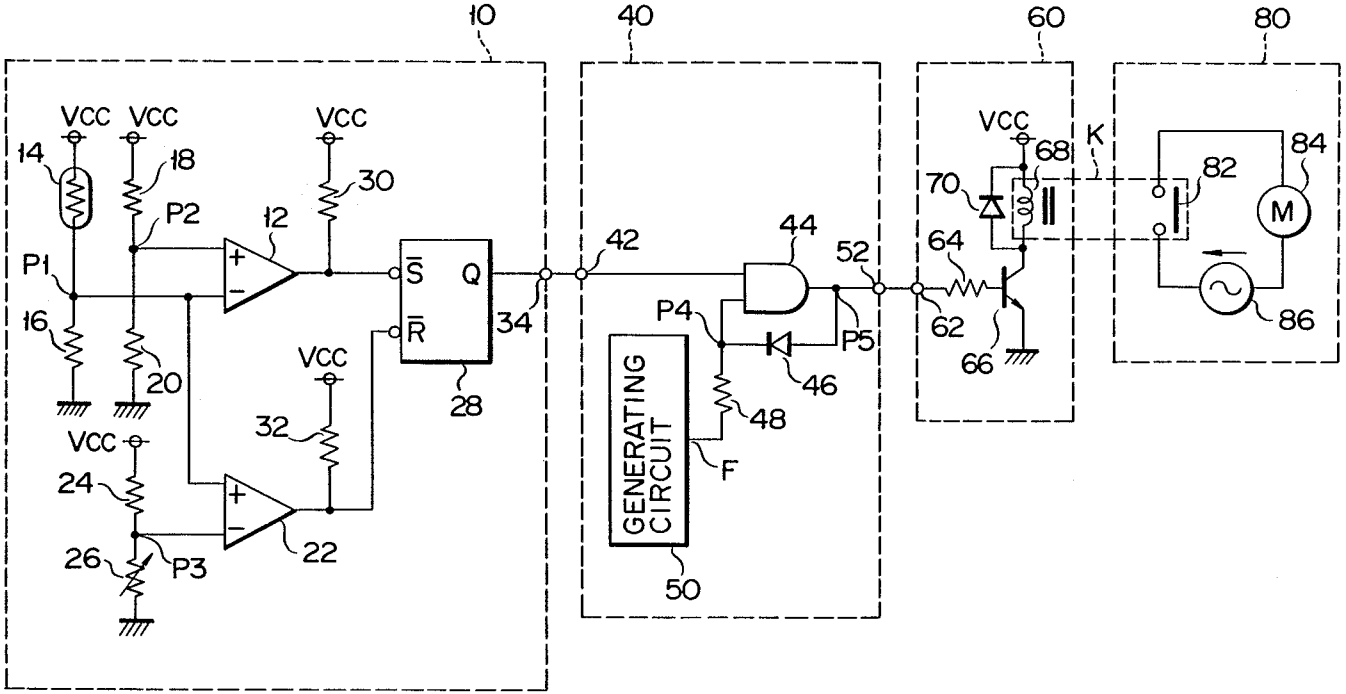
FIG. 1 is a circuit diagram showing a relay drive circuit according to a first embodiment of the present invention.

FIG. 1 shows a first embodiment of the invention, and more precisely, a circuit for driving the motor of a compressor used in the refrigerator. As is shown in this figure, the motor drive circuit has a detector section 10, timing control circuit 40, relay drive section 60, and AC circuit 80. Detector section 10 detects a parameter, in this embodiment the temperature within the refrigerator and produces a signal for driving the motor of the compressor provided in the refrigerator. In section 10, one input terminal (−) of comparator 12 is coupled to node P1 of temperature sensor 14 (e.g., a thermistor) and resistor 16 which are connected in series between DC power source Vcc and the ground. The resistance of thermistor 14 decreases as the temperature within the refrigerator rises, and increases as this temperature falls. The voltage applied to node P1 therefore rises and falls in proportion to the temperature. The other input terminal (+) of comparator 12 is coupled to node P2 between two resistors 18 and 20 which are connected in series between DC power source Vcc and the ground. Another comparator 22 is provided within detector section 10. One input terminal (+) of comparator 22 is connected to node P1. The other input terminal (−) between comparator 22 is coupled to node P3 of resistor 24 and variable resistor 26 which are connected between DC power source Vcc and the ground. The resistance of variable resistor 26 is adjusted such that the voltage applied to node P3 is lower than that applied to node P2.

The output terminal of comparator 12, which is of an open-collector type, is connected to set terminal $\overline{S}$ of flip-flop 28, and also to DC power source Vcc by resistor 30. The output of comparator 12 is at a low (L) level when the voltage applied to node P1 is higher than that applied to node P2. Conversely, it is at a high (H) level when the voltage applied to node P1 is lower than that applied to node P2. The output terminal of comparator 22 is connected to reset terminal $\overline{R}$ of flip-flop 28, and also to DC power source Vcc by resistor 32. The output of comparator 22 is at the H-level when the voltage applied to node P1 is higher than that applied to node P3. Conversely, it is at the L-level when the voltage applied to node P1 is lower than that applied to node P3. Output terminal Q of flip-flop 28 is connected to output terminal 34 of detector section 10.

When the voltage applied to node P1 rises above the reference voltage of node P2 as the temperature within the refrigerator rises, the output voltage of comparator 12 falls to the L-level. The output voltage of comparator 22 rises to the H-level at this time. Flip-flop 28 is thereby set. As a result, the detection signal at the H-level is supplied from output terminal Q to input terminal 42 of timing control circuit 40. On the other hand, when the voltage applied to node P1 falls below the reference voltage of node P3 as the temperature in the refrigerator falls, the output voltage of comparator 22 falls to the L-level. In this case, flip-flop 28 is reset, whereby the detection signal falls to the L-level.

Timing control circuit 40 is designed to operate in two different timing sequences. In one, timing control circuit 40 alternately opens and closes relay K in synchronism with the positive and negative cycles of the voltage applied from an AC power source for driving AC circuit 80. In the other mode, timing control circuit 40 opens and closes relay K randomly. Timing control circuit 40 has a feedback circuit comprising AND gate 44 and diode 46 whose cathode, or node P4, is connected to the first input terminal of AND gate 44 and whose anode, or node P5, is coupled to the output of AND gate 44. In circuit 40, generating circuit 50 is provided to initialize relay drive section 60 and to drive relay K at random. The output terminal F of this circuit 50 is connected by resistor 48 to the first input terminal of AND gate 44. The node-cycle period of the output voltage of circuit 50 is different from that of the output voltage of the AC power source, so that the signal output from terminal F has a cycle longer than that of the output signal of the AC power source and is thus asynchronous with the output signal of the AC power source. Input terminal 42 of timing control circuit 40 is connected to the second input terminal of AND gate 44. The output terminal of AND gate 44 is connected to the output terminal 52 of timing control circuit 40.

Output terminal 52 of timing control circuit 40 is coupled to input terminal 62 of relay drive section 60. In section 60, the base of transistor 66 is connected by resistor 64 to input terminal 62. The collector of transistor 66 is connected to exciting coil 68 of relay K, which in turn is connected to DC power source Vcc. Diode 70 is connected in parallel to exciting coil 68, such that its cathode is coupled to DC power source Vcc. The emitter of transistor 66 is grounded. Transistor 66 is turned on when the keying control signal of relay K is at the H-level. When transistor 66 is turned on, exciting coil 68 is excited. On the other hand, when the keying control signal of relay K is at the L-level, transistor 66 is turned off, thus stopping the excitation of coil 68.

In AC circuit 80, movable contact 82 of relay K, which is driven by exciting coil 68, and motor 84 for driving the compressor are connected in series to AC power source 86 for applying the AC voltage of the predetermined frequency. The application of this AC voltage is controlled by the movement of movable contact 68 of relay K.

Figure 2:
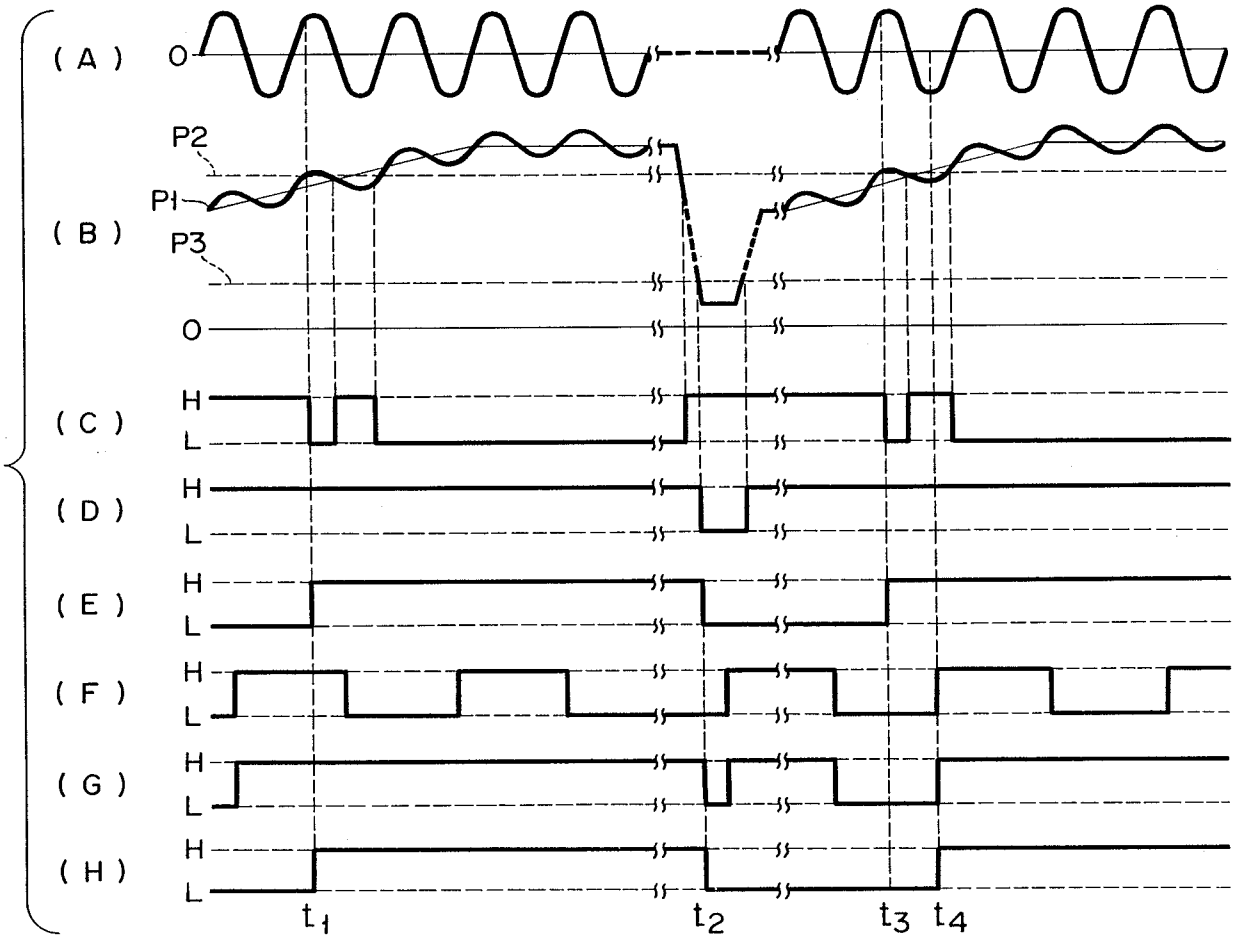
FIGS. 2A to 2H are timing charts explaining the operation of the relay drive circuit shown in FIG. 1.

The operation of the relay drive circuit shown in FIG. 1 will now be explained with reference to the timing charts of FIGS. 2A to 2H. FIG. 2A shows the waveform of the output voltage of AC power source 86. Curve P1 in FIG. 2B represents the waveform of the voltage applied to node P1. Broken lines P2 and P3 in FIG. 2B indicate the levels of the voltages applied to nodes P2 and P3, respectively. The horizontal solid line in FIG. 2B shows the zero-level of the voltage. FIG. 2C shows the waveform of the voltage at set terminal $\overline{S}$ of flip-flop 28 (FIG. 1). FIG. 2D represents the waveform of the voltage at reset terminal $\overline{R}$ of flip-flop 28. FIG. 2E shows the waveform of the voltage at output terminal Q of flip-flop 28. FIG. 2F shows the waveform of the voltage applied to output terminal F of generating circuit 50. FIG. 2G illustrates the waveform of the voltage at node P4, and FIG. 2H shows the waveform of the voltage at node P5.

Immediately after the start of the power supply to the refrigerator, or when the motor of the compressor is not driven, the air in the refrigerator is not cooled, and the temperaure within the refrigerator gradually rises under the influence of the ambient temperature. The voltage applied to node P1 therefore rises. Assume that this voltage rises above the voltage applied to node P2 at time $t_1$. At time $t_1$, a voltage in phase with the output voltage of AC power source 86 is induced at point P1. The induced voltage is pulsative. At time $t_1$, the voltage at set terminal $\overline{S}$ of flip-flop 28 falls from the H-level to the L-level, while the voltage at reset terminal $\overline{R}$ of flip-flop 28 is at the H-level. Therefore, the voltage at output terminal Q of flip-flop 28 rises to the H-level, and then remains at this level.

If the voltage at output terminal F is at the H-level at time $t_1$, the voltage at node P4 rises to the H-level. As a result, AND gate 44, which receives the voltage at node P4 and the output signal of flip-flop 28, produces an output signal. Hence, the voltage applied to node P5 rises from the L-level to the H-level. This voltage remains at the H-level after time $t_1$, even if the output voltage (F) of circuit 50 falls to the L-level. This is because a current flows through diode 46, and a voltage drop occurs in resistor 48. The voltage at node P5 therefore remains at the H-level until the next time the voltage at output terminal Q of flip-flop 28 falls to the L-level. Thus, movable contact 82 of relay K is closed at time $t_1$, that is, during the positive phase of the output voltage of AC power source 86. Motor 84 is thereby started, thus driving the compressor, whereby the temperature within the refrigerator falls.

When the temperature within the refrigerator falls to a prescribed value, it is so controlled as to fall no more. In order to maintain the temperature within the refrigerator, motor 84 is stopped at time $t_2$ when the voltage at node P1, which is provided within the refrigerator, falls below the voltage applied to node P3. More specifically, at time $t_2$, the voltage at set terminal $\overline{S}$ of flip-flop 28 is at the H-level, the voltage at reset terminal $\overline{R}$ thereof falls from the H-level to the L-level, causing the output voltage (Q) of flip-flop 28 to fall from the H-level to the L-level. As a result, the voltage applied to node P5 falls to the L-level, whereby motor 84 is turned off.

When the temperature within the refrigerator falls to the prescribed value, the compressor is stopped. This alternate on and off operation thereby maintains the temperature at a valve close to the prescribed level. More specifically, at time $t_2$, set terminal $\overline{S}$ of flip-flop 28 remains at the H-level, reset terminal $\overline{R}$ thereof falls from the H-level to the L-level, and output terminal Q thereof also falls from the H-level to the L-level. As a result, the voltage at node P5 also falls to the L-level, whereby motor 84 for the compressor is stopped.

Once motor 84 has been stopped, the temperature inside the refrigerator starts rising, since the temperature outside the refrigerator is higher. The voltage at node P1, therefore, rises. When this voltage rises above the voltage at node P2 at time $t_3$, the output voltage (Q) of flip-flop 28 rises to the H-level, as at time $t_1$. At time $t_3$, the voltage applied to node P4 is at the L-level if the output voltage (F) of generating circuit 50 is also at the L-level. Hence, AND gate 44 produces no output signals, and the voltage at node P5 remains unchanged.

Thereafter, when the output voltage (F) of circuit 50 rises to the H-level at time $t_4$, the voltage applied to node P4 also rises to the H-level. AND gate 44 therefore produces an output signal, whereby the voltage applied to node P5 rises to the H-level. After time $t_4$, the voltage at node P4 remains at the H-level even if the output voltage (F) of circuit 50 falls to the L-level, in the same way as for some time after time $t_1$. In this case, movable contact 82 of relay K is closed during the negative phase of the output voltage AC power source 86 at time $t_4$.

Then, the temperature within the refrigerator again starts rising. When it rises above the predetermined value, motor 84 is turned on, as it was at time $t_2$. The temperature within the refrigerator, therefore, falls.

As has been described, the voltage signal output by generating circuit 50 is not in phase with the output voltage of AC power source 86. Hence, the movable contact 82 of relay K is not always closed during the positive phase of the AC power source voltage, or always closed during the negative phase thereof. In other words, the time when the contact 82 of relay K is closed falls alternately during the positive and negative phases of the AC power voltage, and this alteration is completely at random. The ions of the material forming contact 82 generated by heating contact 82, therefore, do not move in only one direction. Hence, relay K is readily protected from contact welding.

Figure 3:
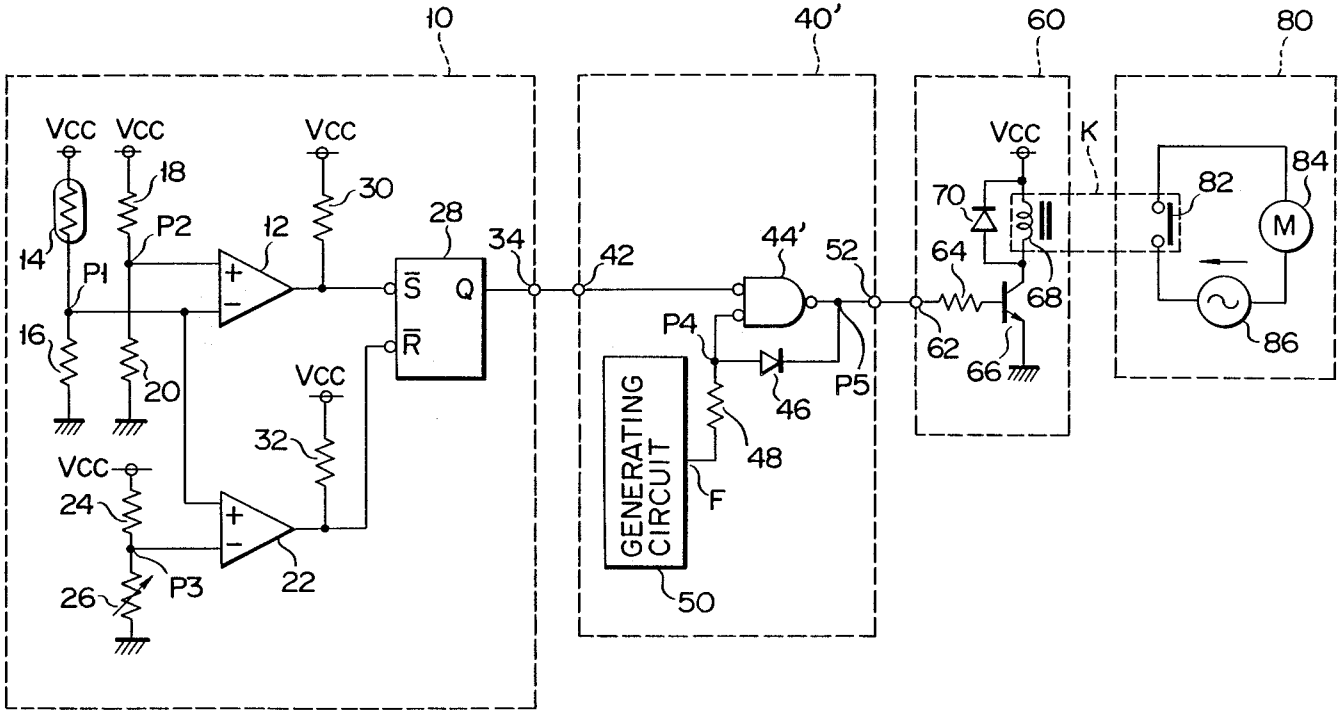
FIG. 3 is a circuit diagram illustrating a relay drive circuit according to a second embodiment of the invention.

FIG. 3 shows a relay drive circuit, of a second embodiment of the present invention. As can be understood from a comparison of FIG. 3 with FIG. 1, the second embodiment is different from the first in only two respects. First, OR gate 44' is used instead of AND gate 44, i.e., AND gate 44 is used in positive logic and OR gate 44' in negative logic. Secondly, diode 46 is connected such that its anode and cathode are coupled to node P4 and P5, respectively, not vice versa, as in the first embodiment. Hence, OR gate 44' produces an output when the output voltage (Q) of flip-flop 28 and the voltage at node P4 are both at the L-level. In FIG. 3, the same numerals are used, designating the same elements as used in the first embodiment of FIG. 1.

The relay drive circuit shown in FIG. 3 operates in the same way as the circuit of FIG. 1, except that timing control circuit 40' outputs a signal when the output voltage (Q) of flip-flop 28 and the voltage at node P4 are both at the L-level. Also in the circuit of FIG. 3, contact 82 of relay K is opened at random.

Figure 4:
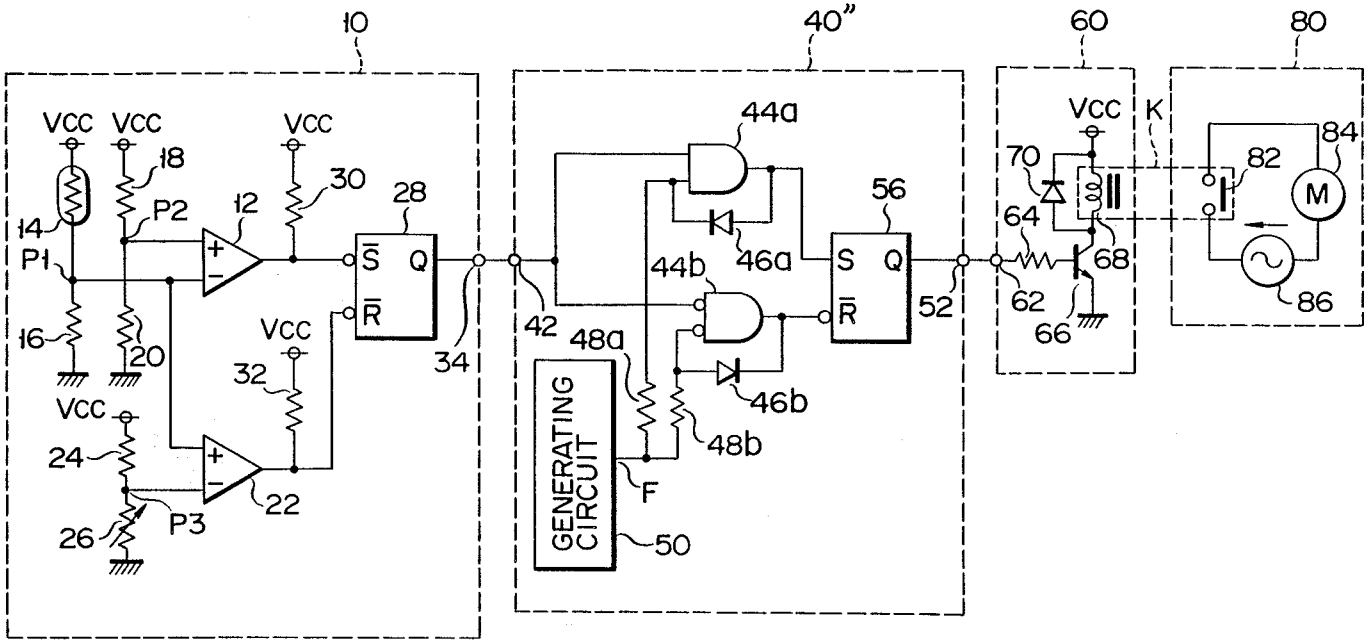
FIG. 4 is a circuit diagram showing a relay drive circuit according to a third embodiment of this invention.

FIG. 4 shows a relay drive circuit, of a third embodiment of the present invention. As can be understood from a comparison of FIG. 4 with FIGS. 1 and 3, the third embodiment is different from the first and second embodiments in that timing control circuit 40'' has flip-flop 56, a first feedback circuit comprising AND gate **44*a* and diode 46*a*, and a second feedback circuit comprising OR gate 44*b* and diode 46*b***.

Output terminal F of generating circuit 50 is connected by resistor **48*a* to the first input terminal of AND gate 44*a*. The cathode of diode 46*a* is coupled to the first input terminal of AND gate 44*a*. The anode of diode 46*a* is connected to the output terminal of AND gate 44*a*. Input terminal 42 is coupled to the second input terminal of AND gate 44*a*. The output terminal of AND gate 44*a* is connected to set terminal S of flip-flop 56**.

The output terminal F of generating circuit 50 is also connected by resistor **48*b* to the first input terminal of OR gate 44*b*. The cathode of diode 46*b* is coupled to the output terminal of OR gate 44*b*. The anode of diode 46*b* is connected to the first input terminal of OR gate 44*b*. Input terminal 42 is coupled to the second input terminal of OR gate 44*b*. The output terminal of OR gate 44*b* is connected to reset terminal $\overline{R}$ of flip-flop 56**.

Except for the features mentioned above, the relay drive circuit of FIG. 4 has the same structure as the circuits shown in FIGS. 1 and 3.

In the circuit of FIG. 4, flip-flop 56 is set when the voltage applied to its set input terminal S rises to the H-level, and is reset when the voltage applied to its reset terminal $\overline{R}$ falls to the L-level. Therefore, as in the circuits of FIGS. 1 and 3, the time when the contact 82 of relay K is closed falls alternately during the positive and negative phases of the AC power voltage, or completely at random.

Furthermore, any of the embodiments described above can be modified as will be described below. All of these modifications maintain the contact 82 of relay K being closed alternately during the positive and negative phases of the AC power voltage, the positive or negative being chosen completely at random.

First, the D-input terminal of a flip-flop is connected to the input terminal of timing control circuit 40, and the $\overline{Q}$-output and $\overline{Q}$-output terminals of this flip-flop are connected by an OR gate to output terminal 52 of timing control circuit 40. A delay circuit is connected between this OR gate and the $\overline{Q}$-output terminal of the flip-flop. Contact 82 of relay K is thus repeatedly closed and opened as the $\overline{Q}$-output and the $\overline{Q}$-output terminals of the flip-flop alternately output H-level signals. In addition, due to the delay circuit interposed between the OR gate and the $\overline{Q}$-output of the flip-flop, every H-level signal is delayed and then output from the $\overline{Q}$-output terminal. Therefore, movable contact 82 is closed alternatively during the positive and negative phases of the AC power voltage.

The relay drive circuit according to the present invention can be used in any devices apparatuses that has a parameter affected by a load, and not just a refrigerator. Detector section 10 can be designed so as to detect changes in an electrical value such as a voltage or a current, changes in a physical value such as pressure or position, changes in chemical properties such as the composition of a liquid or gas, or changes in an optical value such as the intensity of infrared rays or ultraviolet rays. Further, motor 84 can be replaced by any other load for driving devices other than a compressor, or by an electric heater.

The present invention is not limited to the technical disclosure of the claims described hereinafter. Various changes and modifications can be made without departing from the spirit and scope of the invention.

What is claimed is:

1. A circuit for driving a relay used in an AC circuit which drives a load and has a protection against contact welding, said circuit comprising:

a relay having at least two contacts, at least one of which is connected to said load, and an excitation coil which selectively connects and disconnects these contacts in response to an applied control voltage;

AC circuit means, having AC power lines, at least one of which is connected to at least one contact of said relay, for applying an AC voltage of a predetermined frequency to said at least one contact to drive said load;

detector means for comparing a parameter controlled by said load with at least one prescribed reference value, and for outputting a signal when said parameter achieves a predetermined relation with the reference value;

timing control means, receiving said output of said detector means, for generating a random-timing control signal in response to the output of said detector means, said random timing control signal randomly transiting to a control state during either the positive or negative half-wave of the AC in response to said output of said detector means transiting to a control state; and relay-driving means for opening and closing said relay in response to the random-timing control signal output by said timing control means.

2. A circuit according to claim 1, wherein said timing control means includes generating means for producing an oscillating signal that is out of phase with said AC voltage, and means for producing said random timing control signal beginning when said oscillating signal and said output of said detector means achieve a predetermined relationship.

3. A circuit according to claim 2, wherein said producing means comprises an AND gate having a first input terminal for receiving a voltage signal generated by said generating means and supplied through a resistor, a second input terminal for receiving said output of said detector means, and an output terminal for outputting the random-timing control signal; and a feedback circuit for forwardly feeding back an output from said AND gate to the first input terminal of said AND gate.

4. A circuit according to claim 3, wherein said AND gate is of a positive logic type.

5. A circuit according to claim 4, wherein said feedback circuit includes a diode whose anode and cathode are connected to the output terminal and first input terminal of said AND gate, respectively.

6. A circuit according to claim 3, wherein said AND gate is of a negative logic type.

7. A circuit according to claim 6, wherein said feedback circuit includes a diode whose anode and cathode are connected to the first input terminal and output terminal of said AND gate, respectively.

8. A circuit according to claim 3, wherein said producing means further comprises a second AND gate, having a first input terminal for receiving a voltage signal generated by said generating means and supplied through a resistor, a second input terminal for receiving said output of said detector means, and an output terminal for outputting the random-timing control signal; a second feedback circuit for forwardly feeding back an output from said second AND gate to the first input terminal of said second AND gate; and a flip-flop having a set terminal for receiving the output signal of said AND gate, and a reset terminal for receiving the output of said second AND gate, said flip-flop outputting a signal, which is timing-controlled in accordance with the output signals of the two AND gates.

9. A circuit according to claim 8, wherein said second AND gate is of a negative logic type.

10. A circuit according to claim 9, wherein said second feedback circuit includes a diode whose anode and cathode are connected to the first input terminal and output terminal of said second AND gate respectively.

11. A circuit as in claim 1 wherein said parameter controlled by a said load includes a pulse current that is in phase with said AC current flowing through said AC power lines, and said detector means includes means for outputting a signal when a positive half-wave of said pulse current becomes greater than said reference value.

12. A circuit for driving a relay used in an AC circuit which drives a load and has a protection against contact welding, said circuit comprising:

a relay having at least two contacts, at least one of which is connected to said load, and an excitation coil which selectively connects and disconnects these contacts in response to an applied control voltage;

AC circuit means, having AC power lines, at least one of which is connected to at least one contact of said relay, for applying an AC voltage of a predetermined frequency to said at least one contact to drive said load;

detector means for comparing a parameter controlled by said load with at least one prescribed reference value, and for outputting a signal when said parameter achieves a predetermined relation with the reference value;

means for producing an oscillating signal that is out of phase with said AC voltage;

means for producing a random signal beginning when said oscillating signal and said output of said detector means achieve a predetermined relationship; and relay-driving means for opening and closing said relay in response to the random control signal.

13. A circuit according to claim 12, wherein said random signal producing means comprises an AND gate having a first input terminal for receiving a voltage signal generated by said generating means and supplied through a resistor, a second input terminal for receiving said output of said detector means, and an output terminal for outputting the random control signal; and a feedback circuit for forwardly feeding back an output from said AND gate to the first input terminal of said AND gate.

* * * * *